US006869288B1

(12) United States Patent
Faulkner et al.

(10) Patent No.: US 6,869,288 B1
(45) Date of Patent: Mar. 22, 2005

(54) TRAINING DEVICE FOR TEACHING PUTTING MECHANICS

(75) Inventors: Robert L. Faulkner, P.O. Box 63, Dorset, VT (US) 05251; Robert P. Faulkner, Fairfax, VA (US)

(73) Assignee: Robert L. Faulkner, Dorset, VT (US)

( * ) Notice: Subject to any disclaimer, the term of this patent is extended or adjusted under 35 U.S.C. 154(b) by 0 days.

(21) Appl. No.: 10/620,478

(22) Filed: Jul. 16, 2003

Related U.S. Application Data

(63) Continuation-in-part of application No. 09/638,519, filed on Aug. 11, 2000, now abandoned.

(51) Int. Cl.[7] ..... A63B 69/36
(52) U.S. Cl. ..... 434/252; 473/277
(58) Field of Search ..... 434/252; 473/257, 473/261, 262, 266, 270, 278, 279

(56) References Cited

U.S. PATENT DOCUMENTS 5,273,284 A * 12/1993 Montgomery ..... 473/258
5,330,179 A * 7/1994 Hampel ..... 473/404
5,409,231 A * 4/1995 Kueng et al. ..... 473/261
5,503,395 A * 4/1996 Cook ..... 473/261
5,645,494 A * 7/1997 Dionne et al. ..... 473/278
5,725,438 A * 3/1998 Dennesen ..... 473/163
5,792,015 A * 8/1998 Hoyt et al. ..... 473/404
5,827,125 A * 10/1998 Lee ..... 473/139
5,913,732 A * 6/1999 Kwakkel ..... 473/267
5,964,668 A * 10/1999 Tai et al. ..... 473/220
6,296,579 B1 * 10/2001 Robinson ..... 473/407
6,386,996 B1 * 5/2002 Foster ..... 473/452
6,443,852 B1 * 9/2002 Kim ..... 473/265

* cited by examiner

*Primary Examiner*—Kurt Fernstrom
(74) *Attorney, Agent, or Firm*—Richard S. Erbe

(57) ABSTRACT

A training device for teaching putting mechanics through implementation of a) suggested predetermined backswing and, if desired, follow-through, stroke lengths for a variety of putting distances, and b) adjustments, by formula, for a variety of putting green/slopes by putting distance.

24 Claims, 9 Drawing Sheets

TRAINING DEVICE FOR TEACHING PUTTING MECHANICS

RELATED APPLICATIONS

This is a continuation-in-part application of application Ser. No. 09/638,519, filed Aug. 11, 2000 now abandoned.

BACKGROUND OF THE INVENTION

1. Field of the Invention

This invention relates to devices used to train golfers in the proper mechanics of putting.

2. General Background and State of the Art

In the game of golf, one of the most important components is putting. In general, putting is expected to comprise approximately fifty percent of the number of strokes a golfer will take in a typical round of golf. The lower the number of strokes a golfer takes (in essence, the lower his score), the better the game result is for the golfer.

In putting, the golfer is trying to take the 1.68 inch diameter dimpled golf ball varying distances across an undulating, sloping and manicured green to sink the ball into a 4.25 inch diameter regulation size golf hole. The golfer must propel the golf ball a finite distance to sink a particular putt—too short a distance and the putt will not be made—too long a distance and the putt will not be made.

The putting game is comprised of a number of variables that the golfer must in some way address. These variables can be divided generally into two categories: a) putting techniques of, for instance, how to grip the club, how to strike the ball, and how to stand over the ball; and b) putting mechanics of, for instance, how far is my ball from the target golf hole, how hard should I hit the ball to sink the putt, and how should I adjust my stance position and putting direction to take into account green breaks/slopes.

The two main putting mechanic variable challenges, distance and direction, have either been ignored or addressed in only the most general and imprecise manners by the prior art. For distance, golfers must decide how far back to bring their putting backswing and how far forward to continue their putting stroke for a particular distance. For direction, golfers must evaluate the particular green and adjust their putting stance for any perceived green break.

Due to the popularity of golf and to the well-known putting variables, there have been a wide variety of putting training devices patented, particularly in the areas of putting technique training.

While certain putting training inventions are known, there are several disadvantages to the known devices. It would appear that inventors in this art had assumed that specific training regarding backstroke and follow-through lengths by putting distance was useful but not possible. To address the issue of backswing and follow-through, ruler-like indicia or broad ranges were provided and the golfers were generally made to rely on their experience. Further, while certain inventions sought to address putting direction, they also failed to provide golfers with specific direction guidance for putts of varying distances. In essence, specific training guidance was arguably assumed to be an insoluble problem. In addition, the prior art apparently assumed that no commonality would be found in such issues due to different size golfers and the many putting variables.

None of the prior art devices known to applicants are based on using proven mathematical techniques.

None of the prior art references known to applicants are based on specific guidance to be used by golfers of virtually all sizes for a wide variety of putting distances and directions.

None of the prior art references known to applicants can be used without depending almost exclusively upon the experience of the individual using the device.

None of the patents identified by the applicants, taken either singly or in combination, is seen to describe the present invention as disclosed and claimed.

SUMMARY OF THE INVENTION

Accordingly, it is an object of the invention to provide a visual guide for developing a specific and consistent backswing for specific putting distances.

Another object of the invention is to provide a visual guide for developing a consistent and appropriate putting stroke speed.

A further object of the invention is to provide a visual guide for developing a specific and consistent follow-through stroke length for, specific putting distances.

Still a further object of the invention is to provide golfers with a device they can use to efficiently practice their backswing and follow-through for putts of various distances using suggested predetermined backswing and follow-through length information.

An additional object of the invention is to provide a practice aid for reading green breaks/slopes and adjusting the putting stroke and its direction for the break of the green.

Another object of the invention is to provide a standard or test by which to judge and correct a golfer's ability to read green breaks/slopes.

A further object of the invention is to provide golfers with a device which they can use to adjust their putting stance direction for perceived green breaks/slopes.

It is yet a further object of the invention to provide a practice aid that may be used by golfers of virtually all shapes and sizes in the same manner.

Another object of the invention is to provide a training device that is portable and can be used on a wide variety of surfaces, both on and off golf courses.

These and other objects and features of the present invention are achieved by the present invention, which, in a broad aspect, provides the user with a training device based on established mathematical principles and techniques that can be used by golfers of virtually all shapes and sizes without requiring adjustments for the variations in shapes and sizes of the user.

The present invention provides significant improvements in putting training devices by addressing the putting-mechanic variables faced by golfers, primarily distance and direction. In its preferred embodiment, the instant invention is a golf putting training device used to train golfers in the proper mechanics of putting. In particular, the invention is designed to assist the golfer (a) to practice his or her distance putting, and (b) to practice his or her distance putting while adjusting for estimated or perceived breaks in the putting surface. In addition, in some embodiments, the instant invention can allow the golfer to practice numerous other putting technique variables of golf putting, including, for instance, body alignment, club alignment, and putter position. The instant invention is a practice tool that can be used with or without a golf ball, but, when used with a ball, is typically placed behind the ball relative to the putting target. Further, the instant invention can be used on a variety of putting surfaces (e.g., golf green, carpet, artificial putting mat), can be made in a portable form or can be incorporated into or attached to an artificial putting surface.

Distance Training: One significant variable in putting is the distance from the golf ball to the target golf cup. The golf ball is of a known diameter. If the distance between the ball and the cup is determined, this variable becomes a constant. The golf ball of known diameter must travel a certain distance. When certain putting variables are assumed at a constant level then suggested predetermined backswing information can be given to golfers of virtually all physical characteristics to improve their putting. In particular, when a) the putting stroke technique used by the golfer is a standard, measurable putting stroke (e.g. pendulum putting stroke); b) the putting surface is a flat putting surface that has virtually no measurable side/side or up/down green breaks; and c) a predetermined putting green speed is used, specific guidance as to an approximate backswing and follow-through putting stroke for specific distances can be given. The pendulum stroke, for instance, is not dependent upon strength, size or wrist action and can be generally-measured and standardized within a relatively small variation range for men, women and juniors. The present invention implements this guidance to provide a standard of measure device to allow golfers to accurately and consistently practice their putting mechanics for distance under specific putting circumstances. This allows the golfer to practice putting in a consistent and measurable way. For example, a golfer who uses the standard pendulum style putting stroke, on a flat putting surface with essentially no green breaks/slopes, where that putting surface has an average stimpmeter speed of 7 to 8, would be able to use the invention with predetermined, suggested backswing and follow-through putting stroke guidance set forth below.

Alternatively, when the golfer is putting under different putting circumstances or for some other reason desires to alter the suggested predetermined marks, the golfer can use this standard of measure device, with its standard markings and information, as a place from which, through trial and error, to consistently and accurately identify alternative backswing and follow-through lengths.

Direction Training: A second important variable in the putting game is the "reading" of the green and adjusting to the "break" of the green (i.e., the left-right and right-left slope of the green). Where such a break exists, an adjustment in the direction of the putt is necessary so that the golf ball will "break" toward and into the golf hole. The task for the golfer is to figure out how large the break will be over a given distance and then adjust the alignment of his or her putting stance and stroke. The instant invention provides a significant teaching aid to train a golfer to learn to visually estimate the putting surface breaks and to properly adjust his or her putting stroke and alignment at varied distances from the target for such breaks. In particular, the invention quantifies such instruction by implementing a well-tested and established angle determination formula set forth below in a golf training device to train a golfer in adjusting his directional angle for breaks at a variety of distances.

Preferred Embodiment. In the preferred embodiment, the invention consists of two flat rectangular panels, one on top of the other, joined at a turntable point at which the panels can rotate on a horizontal plane. The panels together are flat enough to allow a putter to pass over them unobstructed during an ordinary putting stroke. The top panel displays color-coded lines and numbers corresponding to predetermined backswing length-to-putting-distance information. The top panel also includes a semi-circular notch in the "front" end to accommodate a golf ball resting on a putting surface and extendable arrows showing approximate follow-through stroke length information. In addition, the top panel contains a plurality of windows to view information expressed on the bottom panel.

The bottom panel expresses predetermined information relating to putting stroke adjustments at various distances for left-right and right-left breaks of various magnitudes in the putting surface. In the preferred embodiment, this information is expressed in semi-circular bands, and the panels are positioned such that, when the top panel is rotated along the turnable axis point, the appropriate information on the bottom panel is exposed in the windows in the top panel and the putting stroke direction is correspondingly altered to adjust for such breaks.

In practice, the user may (a) practice his or her golf putting stroke without a ball by repeatedly bringing the putting club back to a particular band and numeral on the top panel; or (b) place the device behind a golf ball at a known or estimated distance and practice his or her putting stroke until the ball consistently travels the desired distance when the indicated backswing and follow-through stroke lengths are used. Practicing with this device will, inter alia, train the golfer to use an appropriate stroke speed and to develop a consistent backswing and follow-through for distance putting.

Where a putting surface has no perceptible left-right or right-left break, the device is positioned in a neutral position whereby the ball would be aimed directly at the putting target. Where the surface has a left-right or right-left break, the golfer estimates or measures the magnitude of the break and the distance to the target (e.g., a one-foot break over a ten-foot distance). The golfer then uses the instant invention to assist him or her in adjusting the direction of the putt to account for the break. The golfer keeps the bottom panel aimed at the putting target, rotates the top panel until the window corresponding to the ten-foot backswing length displays the one-foot break marking expressed on the bottom panel. The golfer then putts the ball in the direction indicated, using the predetermined backswing and follow-through lengths indicated on the device for the applicable distance.

The effect is to train the golfer a) to adjust his or her putting swing (backswing and follow-through stroke lengths) to the applicable distance from the ball to the golf hole, b) to read the putting surface correctly for breaks, and c) to adjust his or her putting stroke and alignment for breaks of the green.

Although the preferred embodiment includes both aids for distance putting and for break adjustment, these features can be embodied individually in separate devices. In a separate embodiment, the distance putting portion of the invention takes the form of a flat panel with color coded bands and numerals corresponding to given distances. The placement of the bands and numerals corresponds to predetermined backswing-to-distance relationships, such as (but not limited to) those shown in Table 1. In operation, the device works in a manner similar to the top panel of the preferred embodiment as described herein.

Rather than including a ruler or unmarked pivot arrows, the present invention through the making of reasonable training assumptions, trial and error, and validation where possible through specific formula, provides golfers with a useful device complete with suggested and predetermined training data. Once the golfer can have a standard of measure from which he or she can practice consistently, he or she can adjust more precisely to on-course variations such as uphill and down hill putting, slow or fast greens, and to non-standardized putting techniques used by the golfer. As such, the present invention solves a long-felt, long-existing, but unsolved need to quantify distance putting strokes and green break/slope adjustments.

In addition to implementing this putting mechanics training in a specific device or invention, such training may also be implemented and used to assist golfers in the form of a method of training. This invention or the method of training could be used in golf putting training classes, or in other alternative training vehicles such as instructional materials, golf putting mats, stroke-length calculators (manipulated manually or through the use of microprocessors), computer software, and other visual aids.

The present invention is contrary to the teachings of the prior art—that is the invention goes against the grain of what the prior art teaches. The present invention teaches otherwise in that the present invention shows that backswing/follow-through/and green breaks can be determined and incorporated in a form virtually all golfers can use.

The instant invention makes significant improvements in the existing art of putting mechanics training, in particular distance and direction training.

DETAILED DESCRIPTION OF THE PREFERRED EMBODIMENTS OF THE INVENTION

In the following description of the present invention, reference is made to the accompanying drawings, which form a part hereof, and in which are shown, by way of illustration, an exemplary embodiment illustrating the principles of the present invention and how it may be practiced. It is to be understood that other embodiments may be utilized to practice the present invention and structural and functional changes may be made thereto without departing from the scope of the present invention.

Figure 1:
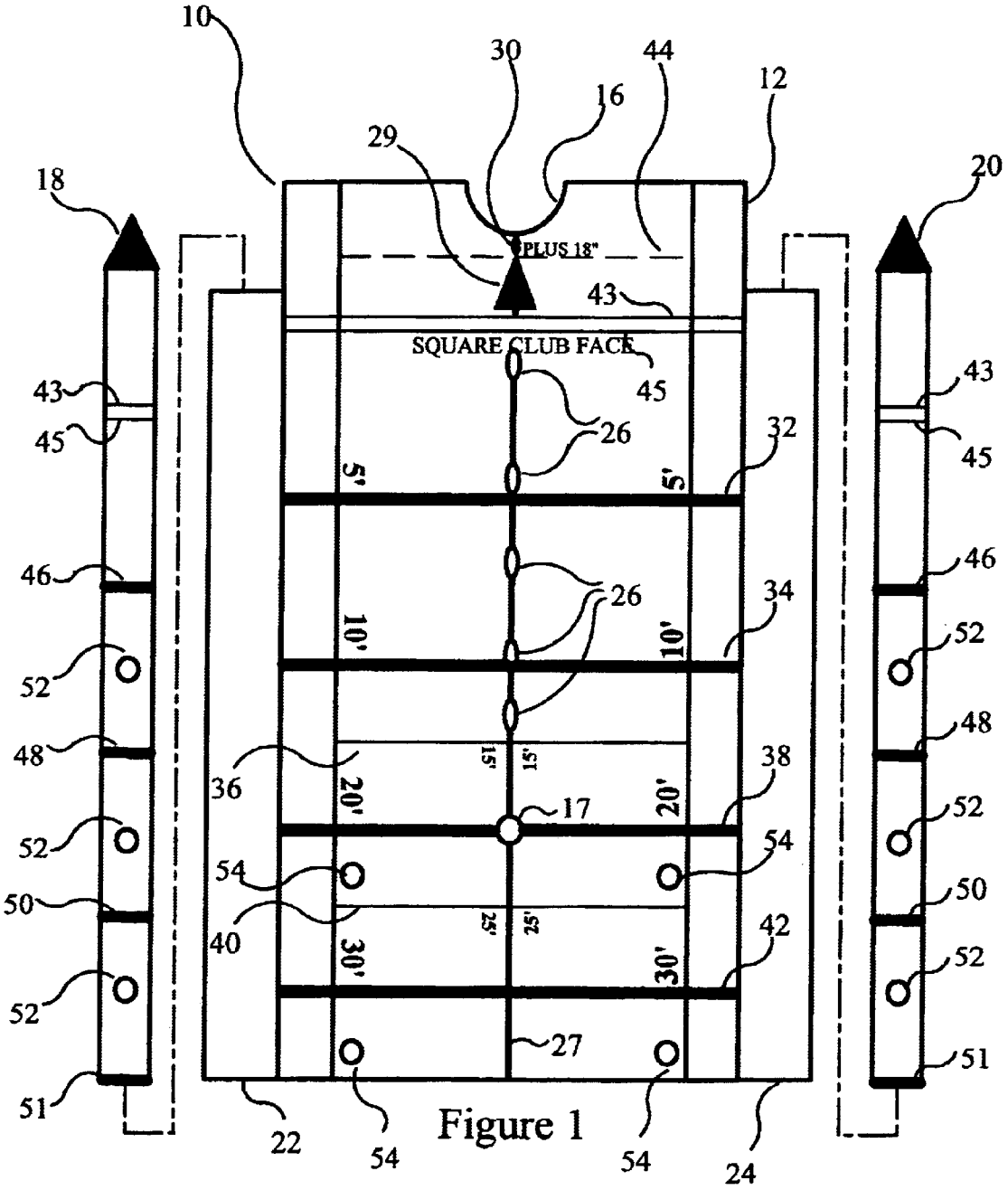
FIG. 1 illustrates a top view of the top panel of the preferred embodiment of the invention.
Figure 2:
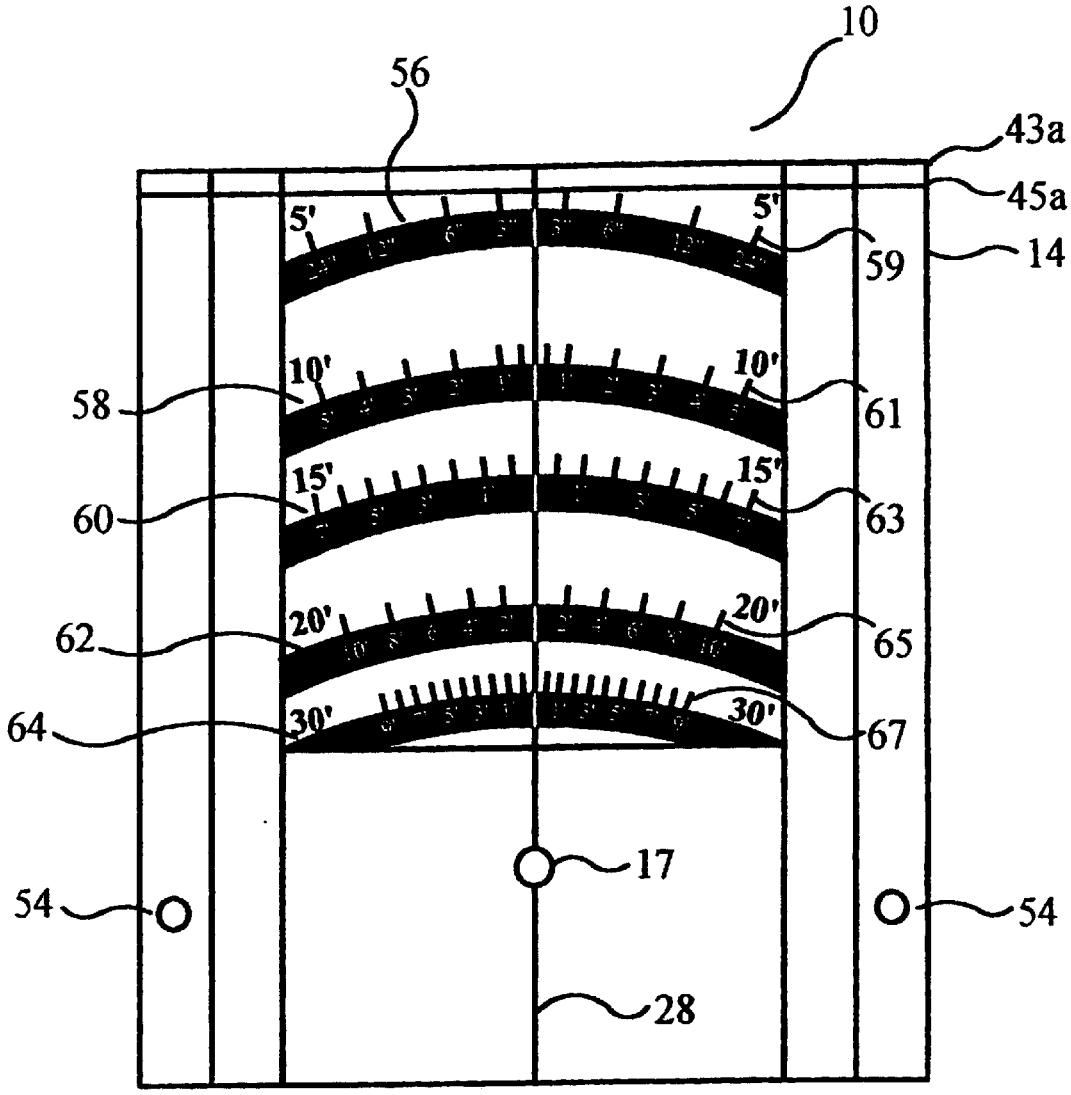
FIG. 2 illustrates a top view of the bottom panel of the preferred embodiment of the invention.

As illustrated in FIGS. 1 and 2, the preferred embodiment of the invention consists of a golf putting training device 10, comprising a flat, rectangular panel 12 connected at an axis by eyelet or other suitable means 17 to a second flat panel 14. The connection allows panels 12 and 14 to rotate but with enough surface friction to ensure that, once adjusted, panels 12 and 14 will remain fixed in position. Both panels 12 and 14 are preferably made of plastic or other material that can retain enough rigidity to maintain a fixed, flat surface at the thickness indicated.

The top panel 12 of the preferred embodiment is preferably about 15" long, 7.5" wide and 1/32" thick, it being understood that different lengths, widths and thicknesses may be used so long as the panel is sufficiently long to accommodate markings which express predetermined backswing-to-putting-distance information (discussed below) and thin-enough so that the fully assembled device 10 does not obstruct the putting stroke. Centered on the top panel 12 is an optional semi-circular ball notch 16, which is sized to accommodate a golf ball resting on the putting surface. Two flat, extendable guides 18 and 20, approximately 15" long by 1.5" wide by 1/32" thick are housed in separate slots 22 and 24 in top panel 12. A plurality of elliptical windows 26, which could be holes or transparencies, are arranged along the center longitudinal line 27 of the top panel 12, as illustrated in FIG. 1. If desired, the windows 26 could be replaced with one elongated window (not shown) or a transparent top panel 12 (not shown). The top panel 12 has additional respectively colored transverse lines 32, 34, 36, 38, 40, and 42 denoting the approximate backswing lengths for the identified putting distances. These transverse lines 32, 34, 36, 38, 40, and 42 are accompanied by written numerals of the same respective color identifying the respective putting distances. The placement of transverse lines 32, 34, 36, 38, 40, and 42 is based on predetermined calculations and/or observations including but not limited to the information contained, for example, in Table 1 below. The top panel 12 also has various optional markings and writings, including (1) a colored, shaded isosceles triangle 29, approximately 1" in length, extending back from a point just behind the apex of ball notch 16 to indicate the direction to a target; (2) a colored longitudinal line 30 positioned just behind ball notch 16 along with a transverse broken line 44 positioned 0.38" behind ball notch 16 to show that the preferred embodiment is calibrated to yield putts that travel 12–18 inches beyond a target, a technique recommended by certain golf professionals in order to assure enough power in the putt to reach the golf hole; and (3) two additional transverse lines 43 and 45 to guide the golfer in properly lining up the putter club face to the golf ball located in the ball notch 16. There are also optional holes 54 in the top panel 12 which can be used to secure the invention to a putting surface.

The two flat extendable guides 18 and 20 are provided to show follow-through stroke length information for putts of various distances. Each of the extendable guides 18 and 20 has transverse lines 46, 48, 50, and 51 color-coordinated with the transverse lines 32, 34, 38, and 42 on the top panel 12, as illustrated in FIG. 1. This combination demonstrates both the approximate backswing and follow-through stroke lengths for putts of various distances. Each of the extendable guides 18 and 20 also has transverse lines 43 and 45 which serve two purposes, a) to, in certain instances, align with the transverse lines 43 and 45 on top panel 12 for longer lines in order to assist in the squaring of the club face behind the golf ball, and b) to serve as the approximate minimum follow-through stroke length stopping place on the guides 18 and 20. The guides 18 and 20 are extended from their separate slots 22 and 24 until the applicable putting distance transverse line 46, 48, 50, or 51 is revealed and aligned with a designated point, such as the edge of top panel 12 containing ball notch 16. The appropriate follow-through stroke length would extend from such identified transverse line 46, 48, 50, or 51 on the guides 18 and 20 to the transverse lines 43 and 45 on the guides 18 and 20. Similarly to the top panel 12, the guides 18 and 20 may incorporate an additional 0.38 inch to the follow-through stroke lengths to yield putts that-travel 12–18 inches beyond a target as discussed above. In addition, optional holes 52 are provided in guides 18 and 20 to allow inverted golf tees or the like to be placed on or in the holes 52 such that, if the putting club makes contact with the tees, a flaw in the putting stroke is revealed. The holes 52 could also be used to secure the guides 18 and 20 to a putting surface, for instance, by use of golf tees pushed through the holes and into a putting surface.

The inventors have no special expertise in determining the approximate backswing and follow-through lengths for various putting distances, and the invention can be adapted to any predetermined information of this type, however, we have developed a set of correlations, expressed in Table 1, showing the proper backswing and follow-through lengths for various putting distances. These correlations are based on the inventors' estimate, drawn from experimentation with a prototype device, of a typical and appropriate stroke length and speed (For Table 1 illustrations assume a) use of pendulum swing putting stroke where golfer's wrists and elbows are virtually motionless and fixed and the stroke relies on the back and forth motion of the arms in a motion that resembles that of a pendulum, b) a flat putting surface with no up/down or side/side green breaks or slopes, and c) an average speed putting green surface such as with a Stimpmeter (green speed measuring device) measurement of, for example, approximately 7 to 8)). The pendulum stroke is not dependent upon strength, size or wrist action and can be generally measured and standardized within a relatively small variation range for men, women and juniors. As such, the correlations are approximate but sufficiently precise to provide substantial guidance to the practice golfer.

It is understood that further experimentation could lead to adjustments in the correlations. This information can be incorporated into a multitude of golf putting training vehicles, including, but not limited to, instructional materials, golf putting mats, stroke-length calculators (manipulated manually or through the use of microprocessors), computer software and other visual aids.

TABLE 1

Approximate Sample Backswing and Follow-Through Stroke Length Guide Measurements.*

| Distance from Center of Golf Ball To Center of Golf Hole | Suggested Approximate Backswing Stroke Length | Suggested Approximate Follow-Through Stroke Length |
|---|---|---|
| 5 Feet | 4.20 in. to 4.50 in. | 2.80 in. to 3.125 in. |
| 10 Feet | 7.25 in. to 7.50 in. | 5.90 in. to 6.20 in. |
| 15 Feet | 9 in. to 9.125 in. | 7.625 in. to 7.75 in. |
| 20 Feet | 10.56 in. to 10.81 in. | 9.19 in. to 9.44 in. |
| 25 Feet | 12.25 in. to 12.38 in. | 10.88 in. to 11 in. |
| 30 Feet | 13.69 in. to 14 in. | 12.375 in. to 12.56 in. |

*All numbers are approximate based upon the following assumptions:
a) use of pendulum putting stroke where the golfer's wrists and elbows are virtually motionless and fixed and the stroke relies on the back and forth motion of the arms in a motion that resembles that of a pendulum,
b) a flat putting surface with no up/down or side/side green breaks or slopes, and
c) an average speed putting green surface such as with a stimpmeter (green speed measuring device) measurement of, for example, approximately 7 to 8). In addition, the numbers reflected above include an additional .38 inch to the backswing and follow-through stroke lengths to putt to 12–18 inches beyond the center of the golf hole as generally recommended by many golf professional instructors.

As illustrated in FIG. 2, bottom panel 14 of the preferred embodiment is approximately 11.25" long, 9.25" wide and 1/32" thick, it being understood that different lengths, widths and thicknesses may be used so long as the panel 14 is short enough to allow the top panel 12 to rotate without having any part of the bottom panel 14 appear in optional ball notch 16 in the top panel 12, wide enough to accommodate markings 56, 58, 60, 62 and 64 showing predetermined correlations related to the break of the green (discussed below), and thin enough so that the fully assembled device does not obstruct the putter during an ordinary putting stroke. Circular holes 54 having a diameter of approximately 0.25" are positioned at the corners to allow the device 10 to be secured to the putting surface with golf tees or other fasteners. The bottom panel 14 includes markings 56, 58, 60, 62, and 64 expressing predetermined correlations related to the break of the green at various distances (discussed below) in such a way that the appropriate correlation will appear in the appropriate window 26 in top panel 12 as top panel 12 is rotated to adjust for the estimated break of the green. Directional notches 59, 61, 63, 65, and 67 appear on respective markings 56, 58, 60, 62, and 64 to assist in accurately aligning top panel 12 along center longitudinal line 27. Bottom panel 14 contains a center longitudinal line 28 to align with the center longitudinal line 27 on top panel 12 in the neutral position where no break is detected and the ball is aligned directly to a target. Optional transverse lines 43*a* and 45*a* on bottom panel 14 may be used to correspond in position to optional transverse lines on top panel 12.

The inventors have no special expertise in determining the appropriate correlation between distance, the break of the putting surface, and the angle of deviation in putter alignment, and the invention can be adapted to any predetermined information of this type. However, we have developed a set of correlations, expressed in Table 2, showing putting stroke adjustments at various distances from the target for left-right and right-left slopes of various dimensions in the putting surface. These correlations are based on the inventors' estimate, drawn from experimentation with a prototype of the invention. As such, the correlations are approximate but sufficiently precise to provide substantial guidance to the practice golfer. It is understood that further experimentation or mathematical calculations could lead to adjustments in the correlations. In particular, the data in Table 2 can be tested and validated by applying the basic Pythagorean Theorem of $L^2=D^2+Y^2$, where L, D and Y comprise three legs of a right triangle on the ground, where the L is the hypotenuse on the ground showing the distance from the golf ball to a specified green break distance (Y) directly to the left or right of the center of the golf hole, D is the distance on the ground from the center of the golf ball to the center of the golf hole and Y is the distance on the ground from the center of the golf hole to the specified or selected green break distance. The angle included between the lines D (drawn from the golf ball to the golf hole) and Y (from the golf hole to the green break adjustment) is a right angle with hypotenuse L opposite thereto. The green break adjustment angle is the angle included between lines D and L, whose tangent is calculated by dividing Y by D, thus determining the angle [ArcTan=Y÷D]. For the present invention, where there is a difference between the location of the center of the golf ball and an invention pivot point, an additional adjustment for any distance between the center of the golf ball and a pivot point would be made by adding that additional distance to D, and L would represent the hypotenuse on the ground showing the distance from the invention pivot point to a specified green break distance as discussed above. This information can be incorporated into a multitude of golf putting training vehicles, including, but not limited to, instructional materials, golf putting mats, stroke-length calculators (manipulated manually or through the use of microprocessors), computer software and other visual aids.

TABLE 2

Approximate angles (in degrees to the left or to the right of a direct line from the center of the golf ball to the center of the target) of putting stroke alignment change at various distances from the putting target to adjust for right-left and left-right breaks in a putting surface. Additional angles (in degrees) can be found using the information below or by using similar information. The numbers below include 10.5 in. distance to the invention pivot point. A direct line from the ball to the target would be 0 degrees.*

| Distance from Center of Golf Ball To Center Golf Hole | Degrees to Adjust For a 6 in. Break Left or Right from Direct Line from Golf Ball to Hole | Degrees to Adjust For a 12 in. Break Left or Right from Direct Line from Golf Ball to Hole | Degrees to Adjust For a 24 in. Break Left or Right from Direct Line from Golf Ball to Hole |
|---|---|---|---|
| 5 Feet | 4.86 | 9.66 | 18.80 |
| 10 Feet | 2.63 | 5.25 | 10.42 |
| 15 Feet | 1.80 | 3.60 | 7.18 |
| 20 Feet | 1.37 | 2.74 | 5.47 |
| 30 Feet | 0.93 | 1.86 | 3.71 |

*The approximate figures herein can be tested and validated by applying the basic Pythagorean Theorem of $L^2 = D^2 + Y^2$, where L, D and Y comprise three legs of a right triangle on the ground, where the L is the hypotenuse on the ground showing the distance from the golf ball to a specified green break distance (See Y) directly to the left or right of the center of the golf hole, D is the distance on the ground from the center of the golf ball to the center of the golf hole and Y is the distance on the ground from the center of the golf hole to the specified or selected green break distance. The angle included between the lines D (drawn from the golf ball to the golf hole) and L (from the golf hole to the green break adjustment) is a right angle with hypotenuse L opposite thereto. The green break adjustment angle is the angle included between lines D and L, whose arc tangent is calculated by dividing Y by D, thus determining the angle. For the present invention, where there is a difference between the location of the center of the golf ball and an invention pivot point, an additional adjustment for any distance between the center of the golf ball and a pivot point would be made by adding that additional distance to D and L would represent the hypotenuse on the ground showing the distance from the invention pivot point to a specified green break distance as discussed above.

It is expressly contemplated that the preferred embodiment could be modified to provide adjustable limit indicators in the top panel to provide an indication that the approximate backswing lengths and/or follow-through putting stroke lengths had been reached or exceeded, or could be wholly or partially incorporated, by way of improvement, into another device that provides such limit indicators. Those skilled in the art will recognize that such limit indicators could be golf tees, an obstruction, audio cues, lasers, electronic sensors, light beams, and the like. Further, it is also expressly contemplated that the preferred embodiment could be modified to provide markings or indicators to be used by the golfer to adjust the training system to the golfer's particular putting situation, swing force, putting stance or putter Further-, it is also expressly contemplated that the preferred embodiment could be modified to include such additional training aids as a) a small mirror placed behind ball notch 16 for golfer positioning over the golf ball, and/or b) inclusion of pictures or representations of how a golf hole appears from the identified putting distances.

Figure 3:
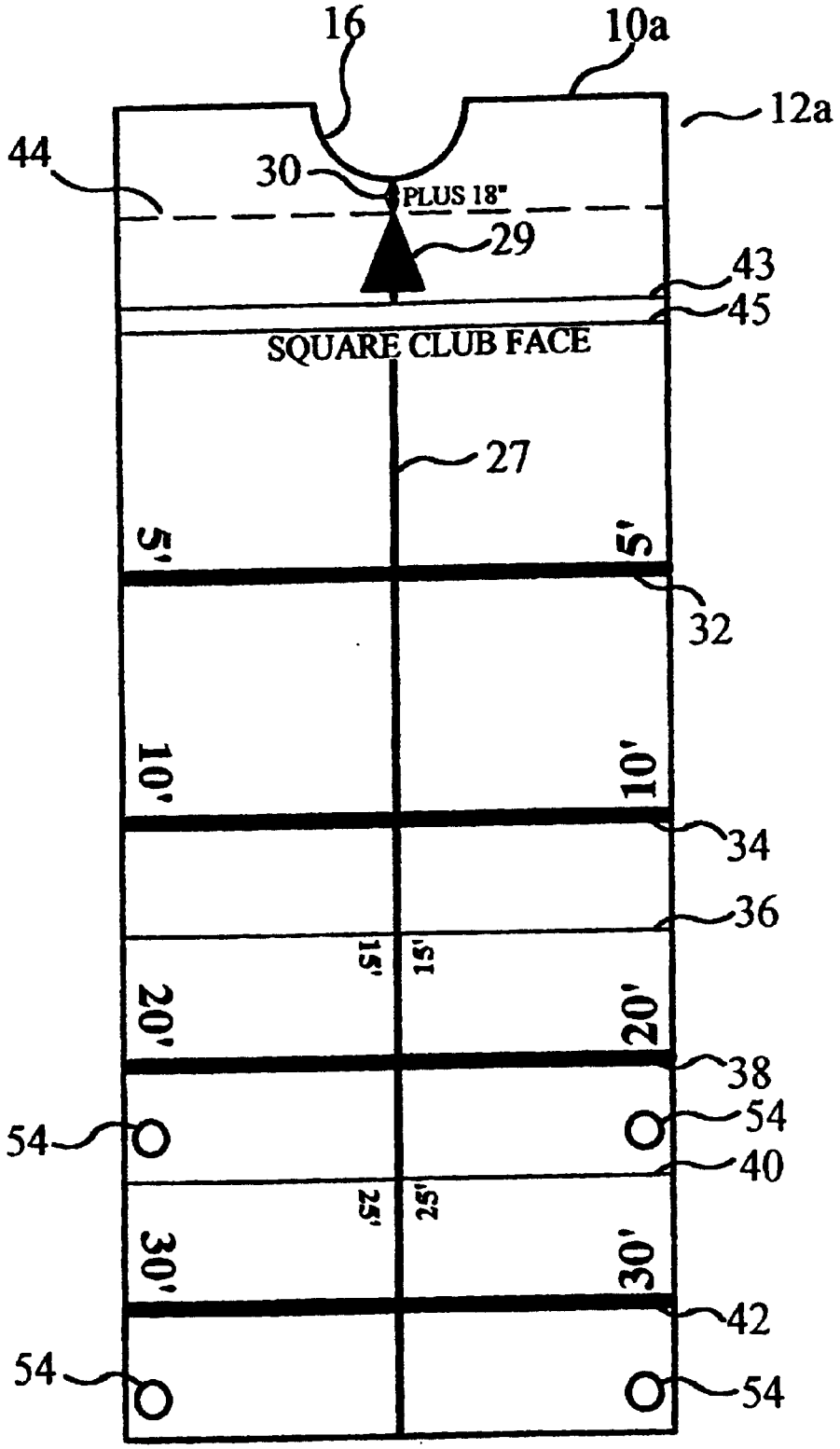
FIG. 3 illustrates a top view of a second embodiment of the invention.

As illustrated in FIG. 3, a second embodiment of the invention is a simplified form of the invention containing only the distance putting feature. This embodiment consists of a golf putting training device 108, comprising a flat, rectangular panel 12*a*. The panel 12*a* is preferably about 15" long, 6" wide and 1/32" thick, it being understood that different lengths, widths and thicknesses may be used so long as the panel is sufficiently long to accommodate markings which express predetermined backswing-to-putting-distance information (discussed herein) and thin enough so that the training device 10*a* does not obstruct the putting stroke. Centered on the panel 12*a* is an optional semi-circular ball notch 16, which is sized to accommodate a golf ball resting on the putting surface. As with the preferred embodiment, optional guides (not shown), similar to such guides 18 and 20 illustrated in FIG. 1, could be added to the device to indicate approximate putting stroke follow-through lengths. The panel 12*a* has additional respectively colored transverse lines 32, 34, 36, 38, 40, and 42 denoting the proper backswing lengths for identified putting distances. These transverse lines 32, 34, 36, 38, 40, and 42 are accompanied by written numerals of the same respective color identifying the respective putting distances. The placement of transverse lines 32, 34, 36, 38, 40, and 42 is based on predetermined calculations and/or observations which may include, but not be limited to, the information contained in Table 1. The panel 12*a* also has various optional markings and writings, including (1) a colored, shaded isosceles triangle 29, approximately 1" in length, extending back from a point just behind the apex of ball notch 16 to indicate the direction to a target in conjunction with centered longitudinal line 27; (2) a colored longitudinal line 30 positioned just behind ball notch 16 along with a transverse broken line 44 positioned 0.38" behind ball notch 16 to show that this embodiment is optionally calibrated to yield putts that travel 12–18 inches beyond a target, which conforms to a technique recommended in some cases by certain golf professionals in order to assure enough power in the putt to reach the golf hole; and (3) two additional transverse lines 43 and 45 to guide the golfer in properly lining up the putter club face to the golf ball located in ball notch 16. There are also optional holes 54 in the panel 12*a* which can be used to secure the invention to a putting surface. The user operates the device as he or she would operate the top panel of the preferred embodiment as described above.

Figure 4:
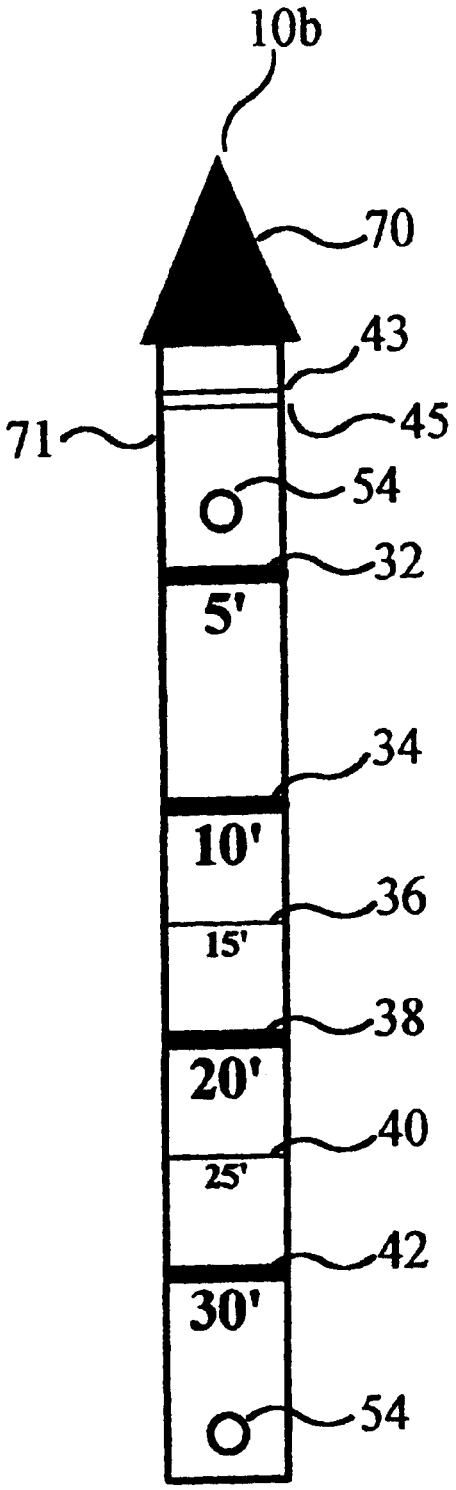
FIG. 4 illustrates a top view of a third embodiment of the invention.

As illustrated in FIG. 4, a third-embodiment is a golf putting training device 10*b* in the form of a flat tape 71 having expressed thereon an arrow 70 indicating the direction of the putt and indicia showing predetermined backswing-to-putting-distance information 32, 34, 36, 38, 40, and 42. There are also optional holes 54 contained in the tape 71 which can be used to secure the invention to a putting surface. Two optional additional transverse lines 43 and 45 to guide the golfer in properly lining up the putter club face to the golf ball could be included. Also, optional additional markings (not shown) could be used to indicate the device includes an additional 0.38 inch to the backswing length information for putting to 12–18 inches beyond the target as discussed above. The tape is made of vinyl or some similar material and is flexible enough to be rolled and unrolled. In operation, the user places the device directly behind the ball in relation to the putting target and practices the putting stroke, using the markings to develop an approximate backswing length for various putting distances.

Figure 5:
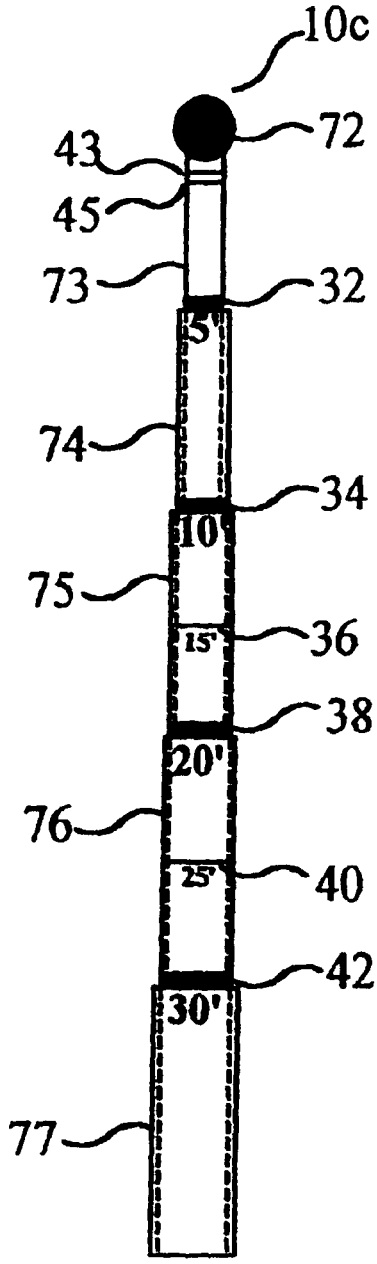
FIG. 5 illustrates a top view of a fourth embodiment of the invention.

As illustrated in FIG. 5, a fourth embodiment is a golf putting training device 10*c* in the form of a thin, telescoping rod 73 consisting of encasement 77 and extensions 74, 75 and 76. When the telescoping rod 73 is fully retracted, it is housed in an encasement 77. There is a tip 72 on rod 73 to facilitate extending rod 73. Rod 73 has indicia showing predetermined backswing-to-putting-distance information 32, 34, 36, 38, 40, and 42 in accordance with the invention. Two additional optional transverse lines 43 and 45 to guide the golfer in properly lining up the putter club to the golf ball are included. Also, optional additional markings (not shown) could be used to indicate the device includes an additional 0.38 inch to the backswing length information for putting to 12–18 inches beyond the target as discussed above. In operation, the user extends the rod to full length as illustrated in FIG. 5 and places it behind a ball in relation to a putting target. It is understood that the device may be placed directly behind the ball or behind and to one side so that it does not impede the putting stroke. The user practices his or her putting stroke as discussed above.

Figure 6:
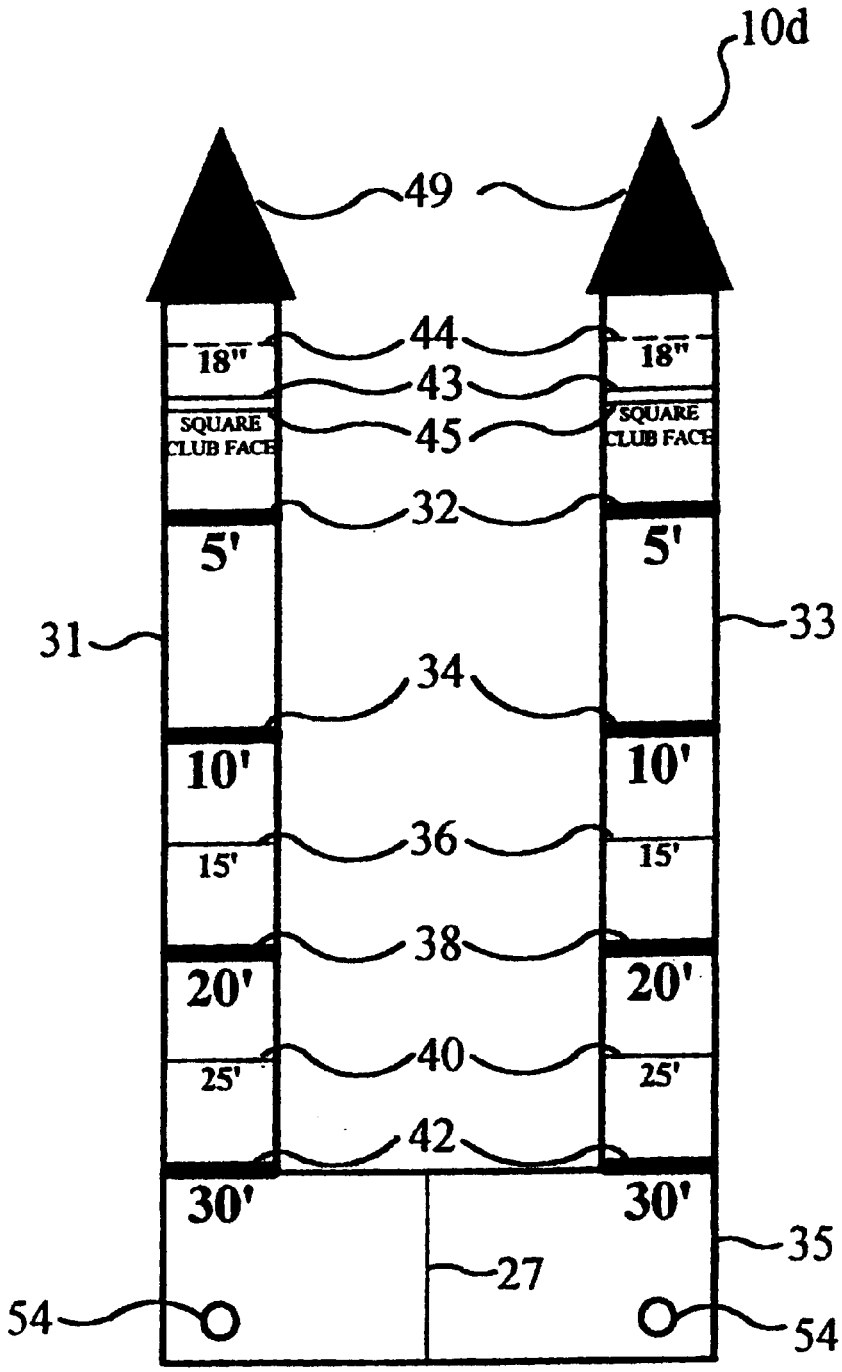
FIG. 6 illustrates a top view of a fifth embodiment of the invention.

As illustrated in FIG. 6, a fifth embodiment is a golf putting training device 10*d* consisting of two fixed flat projections 31 and 33 extending from flat panel 35. Triangular portions 49 are positioned at the ends of projections 31 and 33. Projections 31 and 33 define a space there between that is just larger than the length of the club head of a typical putter. Indicia in accordance with the invention 32, 34, 36, 38, 40, and 42 are expressed on each respective projection 31 and 33. The two guides 31 and 33 may also contain a transverse broken line 44 positioned 0.38" behind the direction indication arrows 49 through which an optional additional distance is added to the predetermined backswing lengths in order to provide for the putting distance target to be a point 12–18 inches beyond the golf hole or target, and two optional additional transverse lines 43 and 45 to guide the golfer in properly lining up the putter club face to the golf ball. Flat panel 35 contains a centered longitudinal line 27 to assist in aligning the device with the target and in centering the golf ball between projections 31 and 33. Flat panel 35 has optional holes 54 to permit fasteners (not shown) to fasten device 10*d* to a putting surface. In operation, the user (a) aligns projections 31 and 33 with a putting target; (b) centers a golf ball between triangular portions 49 with the back of the ball (relative to the target) on the imaginary line extending from the bases of triangular portions 49; and (c) practices putting in accordance with the invention. This embodiment further ensures that the device does not interfere with the putting stroke or the user's view of the putting surface.

Figure 7:
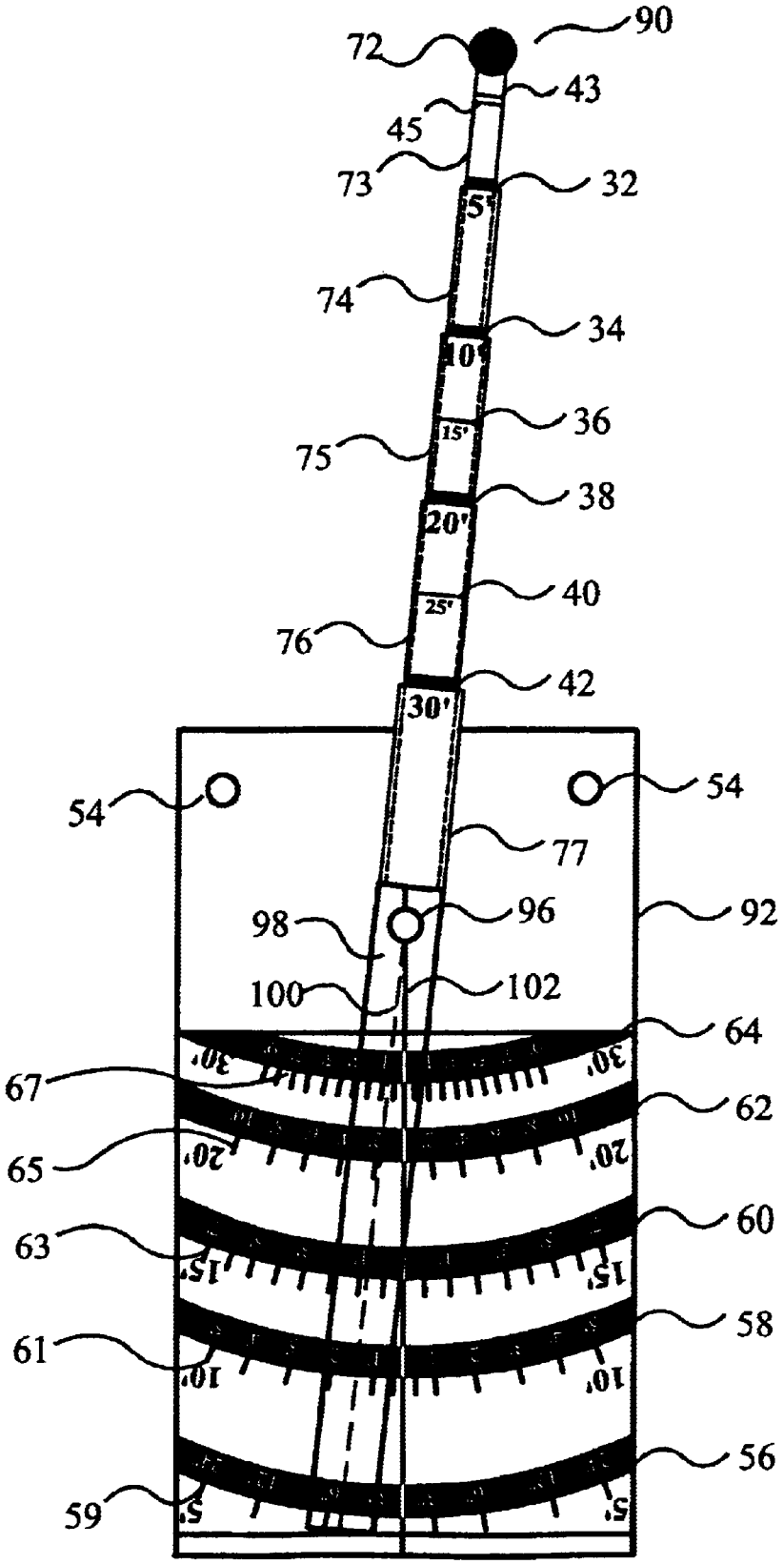
FIG. 7 illustrates a top view of a sixth embodiment of the invention.

As illustrated in FIG. 7, the sixth embodiment is a golf putting training device 90 that consists of a rod 73, connected at its axis by suitable means 96, such as an eyelet, to a flat panel 92. Rod 73 has a telescoping portion including encasement 77, extensions 74, 75, and 76; backswing length indicia 32, 34, 36, 38, 40, and 42; transparent portion 98; and centered longitudinal broken line 100 expressed on transparent portion 98. Rod 73 and the attached clear tape 98 operate as one unit. Where rod 73 moves to the left, the clear tape 98 moves to the right and the reverse. The clear tape 98 has expressed thereon a centered longitudinal broken line that is used to appropriately line up the information on flat panel 92 with Rod 73. Rod 73 also has two optional additional transverse lines 43 and 45 to guide the golfer in properly lining up the putter club face to the golf ball. Also, optional additional markings (not shown) could be used on Rod 73 to indicate the device includes an additional 0.38 inch to the backswing length information for putting to 12–18 inches beyond the target as discussed above. Flat panel 92 includes a central longitudinal line 102, color coded bands 56, 58, 60, 62, and 64 showing break magnitudes at various distances in accordance with the invention as well as notches 59, 61, 63, 65, and 67 on the color coded bands to allow for ease of alignment in putting adjusted for the identified breaks, and optional holes 54 for securing the device to a putting surface. In operation, the user (a) places the device on a putting surface, (b) aligns rod 73 and flat panel 92 with a golf putting target; (c) determines or estimates the distance to the target and the magnitude of the break, if any; (d) adjusts the device to account for any such break by rotating rod 73 until centered longitudinal broken line 100 indicates the appropriate number on the appropriate band 56, 58, 60, 62, and 64 on flat panel 92; and (e) places a golf ball in front of rod 73 or in front and to the side of rod 73. The user practices his or her putting stroke backswing length and adjustment for the breaks of the green as discussed above.

Figure 8:
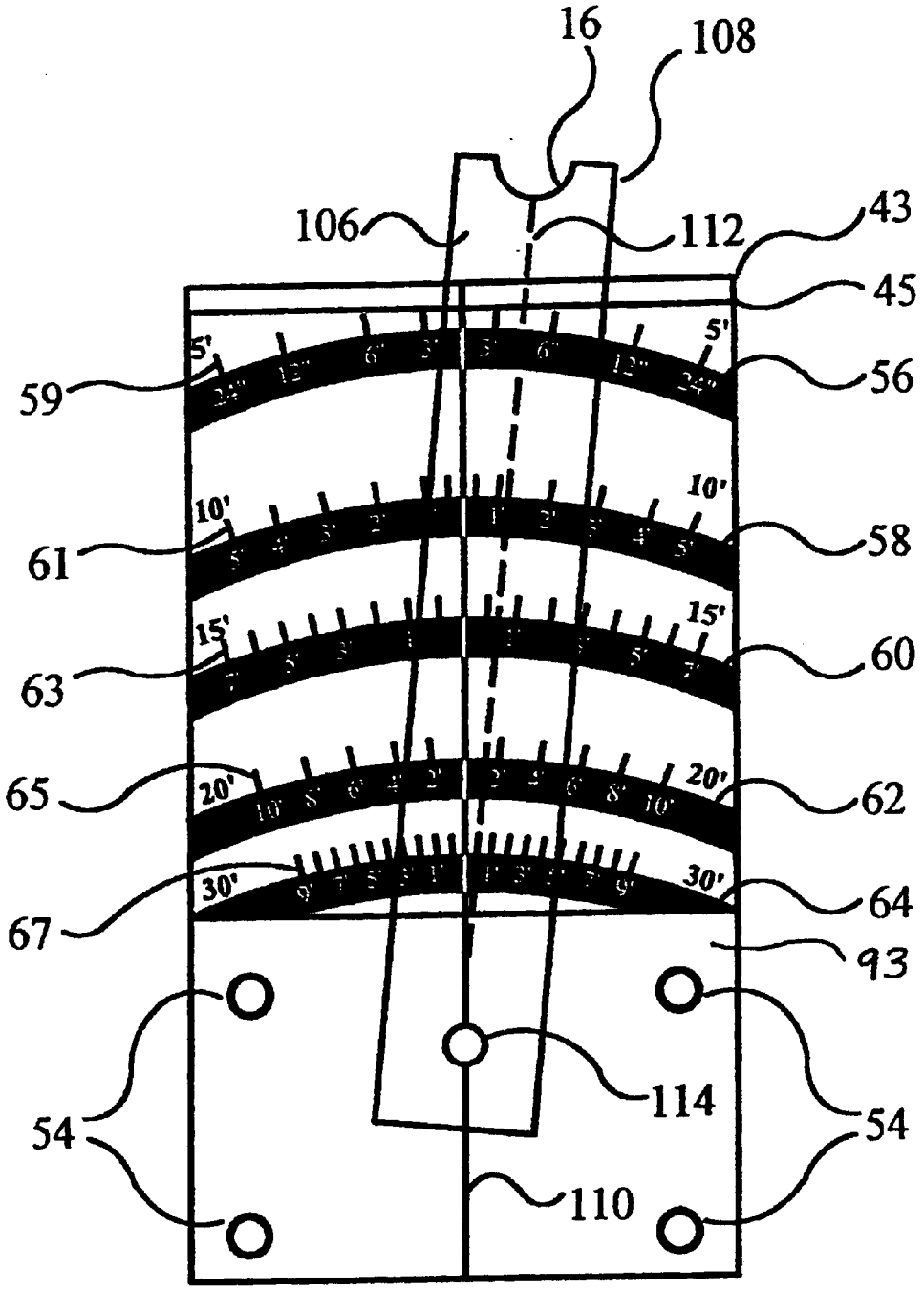
FIG. 8 illustrates a top view of a seventh embodiment of the invention.

As illustrated in FIG. 8, the seventh embodiment is a golf putting training device 108 which is a flat, transparent panel 106 connected at its axis by pivot 114 to flat panel 93. Panel 106 includes ball notch 16 and centered broken longitudinal line 112. Flat panel 93 includes a centered longitudinal line 110, color coded bands 56, 58, 60, 62, and 64 showing break magnitudes at various distances in accordance with the invention as well as notches 59, 61, 63, 65, and 67 on the color coded bands to allow for ease of alignment for putting adjusted for the identified breaks, and optional holes 54 for securing the device to a putting surface. In operation, the user (a) places the device on the putting surface, (b) aligns panel 106 and flat panel 93 with a golf putting target; (c) determines or estimates the distance to the target and the magnitude of the break; (d) adjusts the device to account for the break by rotating panel 106 until centered broken longitudinal line 112 indicates the appropriate number and notch 59, 61, 63, 65, and 67 on the appropriate band on flat panel 93; and (e) places a golf ball in front of panel 106 in ball notch 16 and putts the ball in the indicated direction. Because this embodiment does not include spaced indicia on panel 106 to indicate backswing length information, the device can be much smaller than the preferred embodiment.

Figure 9:
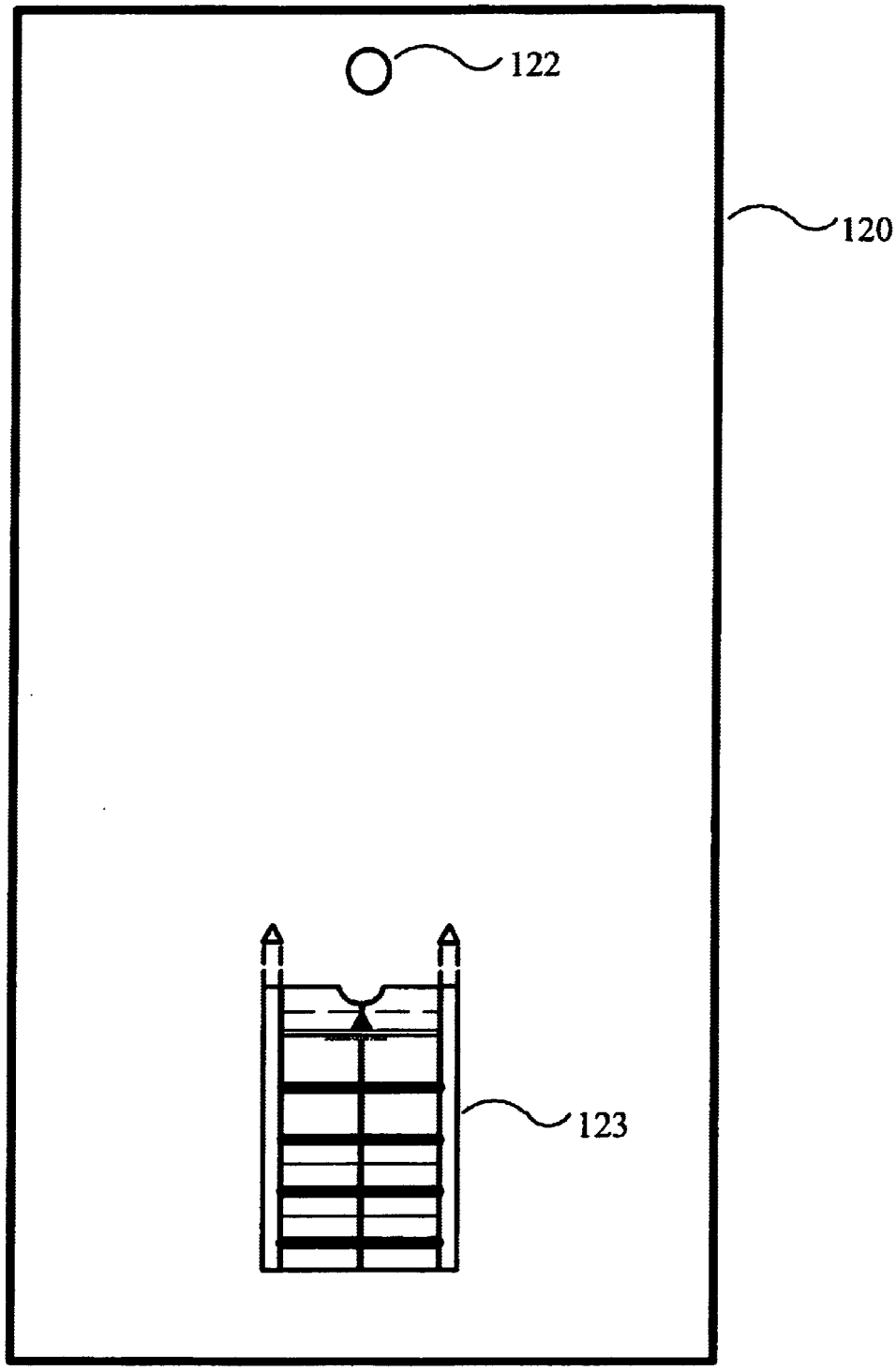
FIG. 9 illustrates a top view of a putting mat including an embodiment of the invention.

FIG. 9 illustrates a putting mat 120 which contains a golf hole/putting target 122. A representation of the preferred embodiment 123 is included with the putting mat. Such preferred embodiment 123 could be temporarily placed on, attached temporarily to, or attached or embedded permanently on, a putting mat 120. It is expressly understood that the putting mat 120 could take a wide variety of shapes and that the device used with the putting mat 120 could take the form of any of the various embodiments discussed or understood herein.

It is understood that the invention can be adapted to account for uphill and downhill slopes by providing means to move the backswing length indicia. For example, an eighth embodiment (not shown) is the preferred embodiment having additional transverse lines to indicate the appropriate backswing length when the putting target is downhill or uphill relative to the placement of the device, and the device further includes removable strips to conceal lines that are not in use. A ninth embodiment (not shown), is the eight embodiment where the additional transverse lines are recessed in transverse grooves and the strips slide along the grooves. A tenth embodiment (not shown) is the fourth embodiment as illustrated in FIG. 5 or the fifth embodiment as illustrated in FIG. 6 with additional indicia representing backswing length when the target is uphill or downhill and the appropriate indicia are disclosed as the extensions are extended and/or rotated.

It is expressly contemplated that the alternative embodiments, where appropriate, could be modified to provide adjustable physical parameters (e.g., adding holes to insert inverted golf tees, including a movable obstruction, including audible or visual indicators) to provide a physical indication that the approximate backswing lengths and/or follow-through putting stroke lengths had been reached or exceeded, or could be wholly or partially incorporated, by way of improvement, into another device that provides such physical parameters. Further, it is also expressly contemplated that the alternative embodiments, where appropriate, could be modified to provide markings or indicators to be used by the golfer to adjust the training system to the golfer's particular putting situation, swing force, putting stance or putter. Further, it is also expressly contemplated that the alternative embodiments, where appropriate, could be modified to include such additional training aids as a) a small mirror placed behind ball notch 16 for golfer positioning over the golf ball, and/or b) inclusion of pictures or representations of how a golf hole appears from the identified putting distances.

The foregoing description of exemplary embodiments of the present invention have been presented for purposes of enablement, illustration, and description. It is not intended to be exhaustive of or to limit the present invention to the precise form discussed. There are, however, other configurations for putting mechanics training devices not specifically described herein, but with which the present invention is applicable. The present invention should therefore not be seen as limited to the particular embodiment described herein; rather it should be understood that the present invention has wide applicability with respect to golf putting training devices. Such other configurations can be achieved by those skilled in the art in view of the description herein. Accordingly, the scope of the invention is defined by the following claims.

What is claimed is:

1. A putting training device comprising:

a first member formed of a flexible material adapted to lie on the ground having expressed thereon indicia positioned to visually represent predetermined backswing length information for a plurality of putting distances, said first member permitting a golf putter to freely pass above or alongside said indicia during a putting stroke, and wherein said first member further includes a notch along an edge sized to receive a golf ball, wherein said indicia are determined through the application of a standard, measurable putting stroke to propel a golf ball toward a golf hole over a putting surface that has substantially no side/side or up/down green breaks or slopes at a predetermined green speed.

2. The device according to claim 1 further comprising:

a second member rotatably connected to said first member permitting said members to rotate on a horizontal plane in relation to each other, said second member indicating a direct path between said device and a putting target while said first member is simultaneously aligned at an angle relative to said direct path to account for an estimated break in a putting surface, wherein said angle is determined in accordance with the formula Arc Tan=Y÷D in accordance with the formula $L^2=D^2+Y^2$, where L, D and Y comprise three legs of a right triangle on the putting surface, D is the distance on the ground from the center of a specified golf ball to the center of a specified golf hole plus any additional distance between the center of the golf ball and the pivot point on the invention, Y is the putting break magnitude, which is the distance on the ground from the center of the golf hole to a specified point to the left or right of the center of the golf hole for a particular green break, and L is the distance on the ground from the pivot point on the invention to the specified point.

3. The device according to claim 2 further comprising:

third indicia on said second member representing a range of putting break magnitudes for a plurality of putting distances; and indicators on said first member to allow the user to rotate said first member to an appropriate angle, relative to said direct path, by reference to said third indicia.

4. The device according to claim 3 further comprising an opening in said first member positioned such that the relevant third indicium on said second member is displayed in said opening.

5. The device according to claim 3 wherein said indicating means show how much the path of the putting stroke will deviate from a straight line between said device and a putting target.

6. The device according to claim 3 wherein said indicating means is a plurality of openings in said first member.

7. The device according to claim 3 wherein said indicating means is a line on a transparent portion of said first member.

8. The device according to claim 3 wherein said indicating means is an extension from said first member.

9. The device according to claim 3 wherein said third indicia are numerals disposed in semi-circular bands.

10. The device according to claim 3 wherein said third indicia are expressed as angles of deviation from said direct path.

11. The device according to claim 3 wherein said third indicia show a suggested putting direction angle adjustment of between five and six degrees for a putting distance of ten feet adjusted for an estimated one foot break on a putting surface.

12. The device according to claim 3 wherein said third indicia show a suggested putting direction angle adjustment of between two degrees and three degrees for a putting distance of twenty feet adjusted for an estimated one foot break on a putting surface.

13. A golf putting training device comprising:

a first member visually indicating a direct path between said device and a putting target when said device rests on a putting surface;

a second member rotatably connected to said first member and sized to permit a golf putter to freely pass over said second member during a putting stroke and having means to visually indicate the direction of a putt; and indicia to numerically show a magnitude of a break, when said first member is aligned with a putting target and said second member is aligned with an estimated break in a putting surface.

14. A golf putting training device comprising:

a first member formed of a flexible material adapted to lie on the ground having indicia thereon representing predetermined putting direction angle adjustments for a plurality of putting distances and a plurality of breaks on a putting surface;

a second member indicating the direction of the putt, said second member being rotatably mounted to said first member, and said second member being positionable for a user to simultaneously view said indicia on the first member and said second member; and said device being sized to permit a golf putter to freely pass above or alongside said first member and second member during a putting stroke.

15. The device according to claim 14, wherein said predetermined putting direction angle adjustments are determined in accordance with the formula Arc Tan=Y÷D in accordance with the formula $L^2=D^2+Y^2$, where L, D and Y comprise three legs of a right triangle on the putting surface, D is the distance on the ground from the center of a specified golf ball to the center of a specified golf hole plus any additional distance between the center of the golf ball and the pivot point on the invention, Y is the putting break magnitude, which is the distance on the ground from the center of the golf hole to a specified point to the left or right of the center of the golf hole for a particular green break, and L is the distance on the ground from the pivot point on the invention to the specified point.

16. The device according to claim 14 wherein said second member is further housed in a third member and said second member may be extended and retracted.

17. The device according to claim 14 wherein said second member has expressed thereon indicia representing predetermined backswing distances for a plurality of putting distances.

18. The device according to claim 14 wherein said second member is transparent.

19. The device according to claim 14 wherein said second member is a flat panel.

20. The device according to claim 14 wherein said second member is a rod.

21. The device according to claim 14 wherein said second member is a tape.

22. A method for practicing putting to compensate for breaks in a putting surface, comprising the steps of:

estimating the magnitude of a break angle for a particular distance from a putting target;

positioning a visual guide behind a golf ball in relation to a putting target, said guide being sized to permit a golf putter to pass over or alongside said guide during the putting stroke, having a first indicator to indicate a direct path between a golf ball and a putting target, a second indicator to indicate the path of the putting stroke, and a third indicator to indicate the magnitude of the deviation between said direct path and said putting stroke path;

aligning said first indicator with said putting target;

aligning said second indicator in accordance with the estimated angle of the break, as indicated by said third indicator; and putting said golf ball along the path indicated by said second indicator, whereby the user can practice adjusting for breaks in the putting surface and improve through standardized trial and error his or her ability to estimate break magnitudes.

23. The method according to claim 22, wherein said angle is determined in accordance with the formula Arc Tan=Y÷D in accordance with the formula $L^2=D^2+Y^2$, where L, D and Y comprise three legs of a right triangle on the putting surface, where D is the distance on the ground from the center of a specified golf ball to the center of a specified golf hole plus any additional distance between the center of the golf ball and the pivot point on the invention, Y is the putting break magnitude, which is the distance on the ground from the center of the golf hole to a specified point to the left or right of the center of the golf hole for a particular green break, and L is the distance on the ground from the pivot point on the invention to the specified point.

24. A method for practicing putting to compensate for breaks in a putting surface, comprising the steps of:

providing predetermined information correlating the putting direction angle adjustment for a plurality of putting distances and a plurality of putting surface breaks;

providing a structure having visual indicators spaced to correspond to said information;

applying the applicable estimated putting surface break and distance to the putting target to said predetermined information and said structure; and positioning said structure in proximity to a chosen putting stroke path such that during the putting stroke, the golfer can perceive the proper putting direction angle adjustment and can alter the putting direction in accordance with the approximate information, wherein said angle adjustment is determined in accordance with the formula Arc Tan=Y÷D in accordance with the formula $L^2=D^2+Y^2$, where L, D and Y comprise three legs of a right triangle on the putting surface, where D is the distance on the ground from the center of a specified golf ball to the center of a specified golf hole plus any additional distance between the center of the golf hall and the pivot point on the invention, Y is the putting break magnitude, which is the distance on the ground from the center of the golf hole to a specified point to the left or right of the center of the golf hole for a particular green break, and L is the distance on the ground from the pivot point on the invention to the specified point, whereby the golfer can practice putting to adjust for perceived breaks in the putting surface and improve through standardized trial and error his or her ability to estimate break magnitudes.

* * * * *